United States Patent [19]

Kogelmann

[11] Patent Number: 4,733,914

[45] Date of Patent: Mar. 29, 1988

[54] APPARATUS TO DELIVER HIGH PRESSURE LIQUID FROM NOZZLES ON A SHEARER DRUM FOR A MINING MACHINE

[75] Inventor: Wilhelm J. Kogelmann, Boalsburg, Pa.

[73] Assignee: Gerb. Eickhoff Maschinenfabrik und Eisengiesserei, Bochum, Fed. Rep. of Germany

[21] Appl. No.: 777,966

[22] Filed: Sep. 19, 1985

[51] Int. Cl.[4] ..... E21C 25/12; E21C 25/60

[52] U.S. Cl. ..... 299/81; 299/17

[58] Field of Search ..... 299/81, 85, 17, 12, 299/42, 1

[56] References Cited

U.S. PATENT DOCUMENTS

| | | | |
|---|---|---|---|
| 4,189,183 | 2/1980 | Borowski | 299/1 |
| 4,488,759 | 12/1984 | Bergqvist | 299/81 |
| 4,506,932 | 3/1985 | Zitz et al. | 299/1 |
| 4,534,597 | 8/1985 | Kemper | 299/81 |
| 4,565,410 | 1/1986 | Hotger | 299/81 |

FOREIGN PATENT DOCUMENTS

| | | | |
|---|---|---|---|
| 3122323 | 12/1982 | Fed. Rep. of Germany | 299/81 |
| 2036127 | 6/1980 | United Kingdom | 299/81 |
| 2070104 | 9/1981 | United Kingdom | 299/85 |
| 0610993 | 6/1978 | U.S.S.R. | 299/81 |
| 0619642 | 8/1978 | U.S.S.R. | 299/81 |

*Primary Examiner*—Stephen J. Novosad
*Assistant Examiner*—David J. Bagnell
*Attorney, Agent, or Firm*—Clifford A. Poff; Thomas H. Murray

[57] ABSTRACT

A shearer drum for a mining machine used in underground mining is provided with cutter picks and nozzles on the periphery of the drum. The nozzles are subdivided into groups which extend substantially parallel to the rotational axis of the drum and each group of nozzles can, when disposed opposite the mine face, be connected by a controllable valve associated with the group to a line for supplying high-pressure liquid. An independent control valve and at least one cutter pick are associated with each nozzle group. The cutter pick is resiliently mounted and cutting pressure triggered by movement of the cutter pick into a mine face actuates the control valve and connects the nozzles to the high-press line.

7 Claims, 5 Drawing Figures

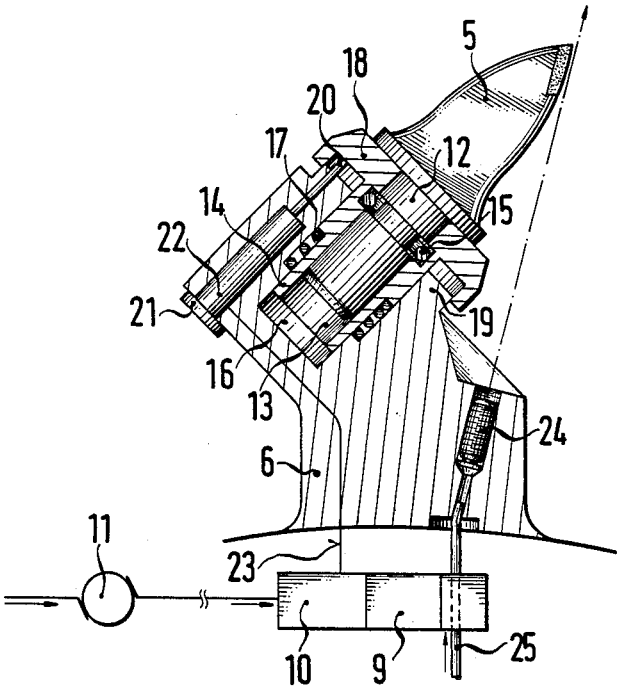
FIG. 4
FIG. 5
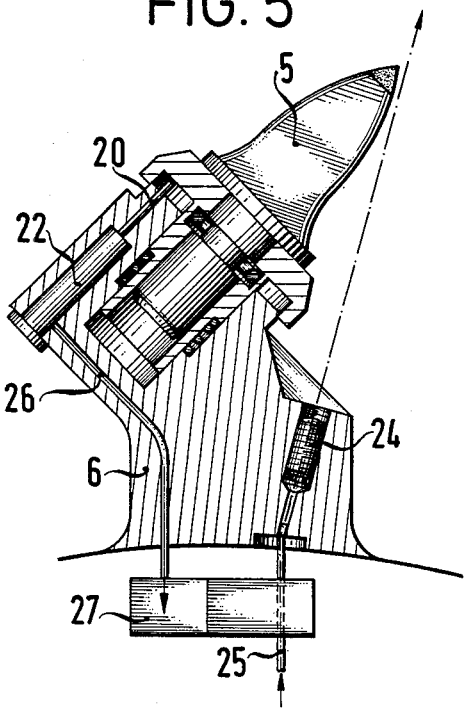

APPARATUS TO DELIVER HIGH PRESSURE LIQUID FROM NOZZLES ON A SHEARER DRUM FOR A MINING MACHINE

BACKGROUND OF THE INVENTION

This invention relates to a shearer drum for a mining machine used in underground mining and more particularly to controlling nozzles disposed on the periphery of the drum together with cutter picks by subdividing the nozzles into groups which extend substantially parallel to the rotational axis of the drum and providing that the groups of nozzles connected by controllable valves to a line-carrying high pressure liquid are controlled to discharge liquid only when disposed opposite the mine face.

In West German Patent Publication No. 3,202,315 there is disclosed a shearer drum having cutter picks on the drum periphery. The operation of the cutter picks is assisted by a stream of high-pressure liquid. In West German Patent Publication No. 3,009,771 there is disclosed high-pressure nozzles on the periphery of a cutter drum which are divided into discrete groups with each group of nozzles being supplied with high-pressure liquid by way of a valve and associated sections of a line when the nozzles of a group are directed toward a mine face. The various valves are actuated by means of a disk which is mounted for rotation around the drum axis and is connected to a clearing plate holder. The disk pivots with the plate holder and depending on the position into which the assembly is pivoted, only the nozzles disposed on one half of the drum periphery which is distant from the plate are connected to the lines supplying high-pressure liquid. European Patent Specification No. 0,010,534 discloses a control for a medium used for cool cutter picks of a shearing tool by means of an axially moveable pick stem or shank. The shank of the pick is resiliently supported against the cutting pressure. The shank of the pick can be displaced against a valve that is used to control the flow of coolant. Of these known disclosures, a system disclosed in German Patent Specification No. 3,009,771 provides that the nozzles in groups are supplied by way of a common valve for each group with high-pressure liquid only when the groups are aimed at the mine face. This is advantageous because it requires relatively few valves to connect only the nozzles on the drum which are directed to the mine face with the high-pressure line. However, an actuating or control disk and an element for actuating and moving the disk into a correct pivoted position is required.

SUMMARY OF THE INVENTION

It is an object of the present invention to solve the problem of delivering high-pressure water directly to the mine face from only a peripheral part of the cutter drum directed thereto in a different and better way than heretofore known without the use of a control disk.

According to the present invention there is provided a shearer drum apparatus for a mining machine used in underground mining, the apparatus including a shearer drum rotatable about an axis and including a line for conducting high-pressure liquid, cutter picks and nozzles spaced about the periphery of the shearer drum, a plurality of control valves each connected for controlling the delivery of high-pressure liquid to one of individual groups of nozzles, each group of nozzles extending substantially parallel to the rotational axis of the drum, and means including a resilient mounting receiving a cutter pick which is associated with the nozzles of each group for actuating the control valve connected to that group of nozzles in response to movement of the cutter pick due to cutting pressure against the mine face.

With this form of operating control, only a single cutter pick is necessary to trigger a control signal and a single valve is required for each group of nozzles. The cost of the control equipment is therefore considerably reduced and therefore also there is a reduction to the likelihood of malfunctioning of the equipment. Conveniently, movement of a cutter pick preferably triggers the production of an electrical or hydraulic signal used to actuate the control valve. To this end, the valves associated with the various groups of nozzles are solenoid valves and piezo-electric detectors or strain gages can be used as a means for enabling cutter pick movement to produce an actuating signal. Alternatively, movement of a cutter pick can be transmitted by way of a column of liquid to a hydraulically operated valve to produce communication between a particular group of nozzles and the line containing high-pressure liquid associated with the shearer drum. The control signal triggered by a cutter pick when entering the mine face is always certain to open a path for the high-pressure liquid to reach the nozzles on the drum which are aimed at the working face and ensure that work by the picks in the mine face is assisted by streams of high-pressure liquid such as water.

These features and advantages of the present invention as well as others will be more fully understood when the following description is read in light of the accompanying drawing in which:

FIG. 4 is an enlarged sectional view through a cutter pick holder together with one embodiment of apparatus for detecting movement of the cutter pick for operating a valve according to the present invention; and FIG. 5 is a sectional view similar to FIG. 4 but illustrating a second embodiment of control apparatus.

Figure 1:
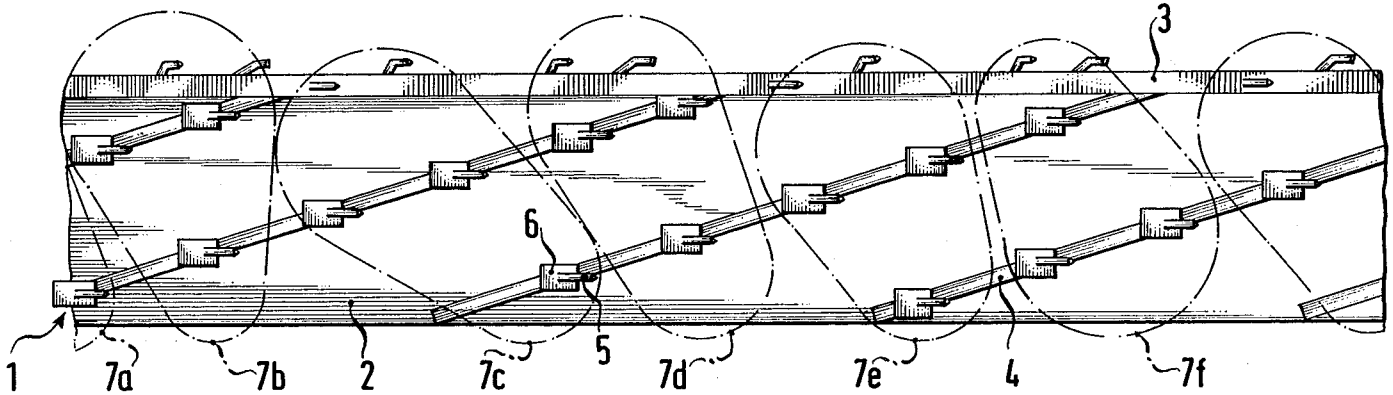
FIG. 1 is a top plane view of a shearer drum stretched out.
Figure 3:
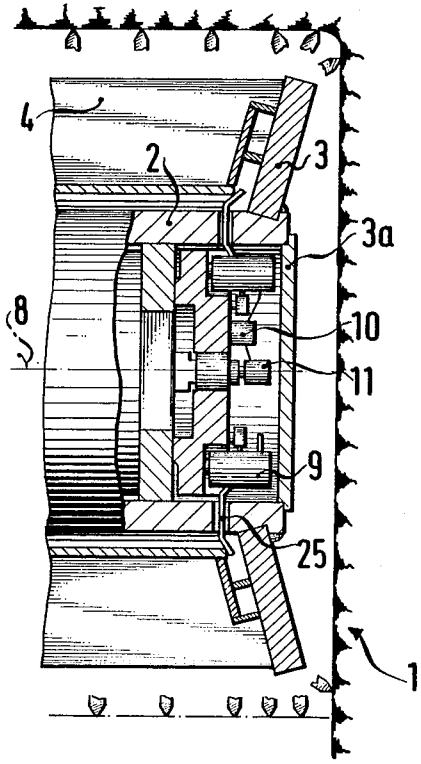
FIG. 3 is a partial longitudinal section through the cutter drum shown in FIG. 2.
Figure 2:
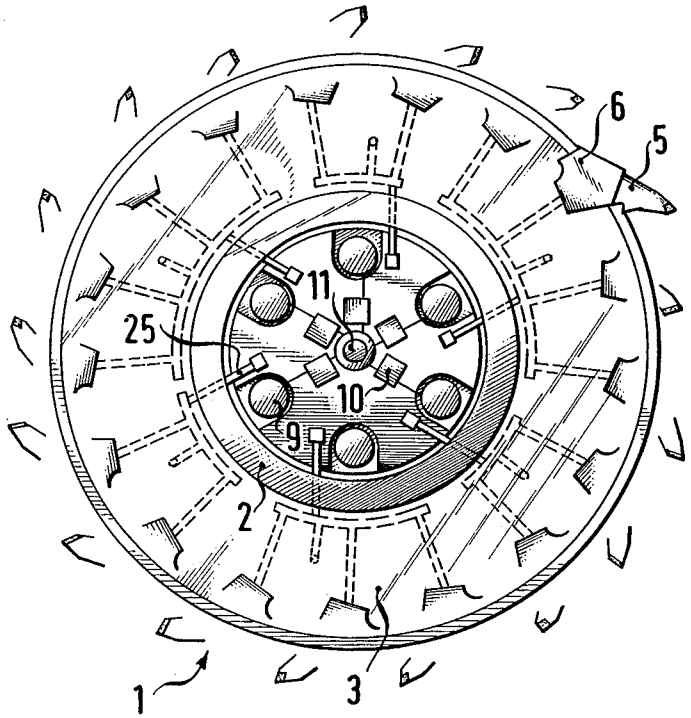
FIG. 2 is an elevational view of a shearer drum taken in a direction toward a closure ring of the shearer drum with the cover removed.

In FIGS. 1–3 there is illustrated a shearer drum 1 which includes a shear drum body 2 and a closure ring 3 having a cover 3A and whorls 4 extending helically around the body 2. Disposed on the ring 3 and the whorls 4 are cutter picks 5 in cutter pick holders 6. As shown in FIG. 1, the cutter picks 5 on the whorls are subdivided into discrete groups 7A–7F which extend substantially parallel to the rotational axis 8 of the shearer drum. As will be explained hereinafter, each holder is provided with a nozzle and all the nozzles of any one of the groups 7A–7F are connected to a common solenoid valve 9 disposed inside the body 2. Each valve 9 is actuated by way of an amplifier 10 which is energized through a common slip ring 11 disposed on the axis of 8, as best shown in FIGS. 2 and 3.

As illustrated in FIG. 4, at least one pick 5 of each group 7A–7F is mounted for axially movement by engagement of the stem or shank 12 of the pick in a bore 13 of a sleeve 14 to which it is connected by a circlip 15. Sleeve 14 is disposed for axially movement in a blind bore 16 formed in holder 6. The sleeve bears against a spring 17 in the bore. A collar 18 of the sleeve 14 extends around an annular surface 19 of the pick. A rod 20 projects from surface 19 and engages the end face of a recessed part of collar 18. Rod 20 is spring biased and when the pick enters the mineral of the mine face, the rod 20 together with the pick and sleeve move in the blind bore 16 against the pressure of the spring. In the embodiment of the pick assembly shown in FIG. 4, a pressure detector 21 is located with the spring in a tubular member 22 that in turn receives the rod 20 located in the bore of the holder 6. This bore extends parallel to the shank or stem 12. The pressure detector 21 can, for example, take the form of a piezo-electric transducer which responds to a load imposed on the rod 20 by way of the spring and produces a signal which is delivered by line 23 to amplifier 10. The pressure detector 21 can be a strain gage to convert the cutting force acting on the pick 5 into a control signal which will be applied to amplifier 10 to operate the solenoid valve 9 and connect nozzle 24 at the base of the holder 6 to a high-pressure water line 25. The line 25 is disposed inside the shearer drum and can instantaneously supply high-pressure liquid to all nozzles 24 that form part of a particular pick group 7A–7F.

In the embodiment shown in FIG. 5, the rod 20 which moves in the same manner as described previously in regard to the embodiment of FIG. 4, responds to axial movement of the pick 5 by way of a spring biased piston, not shown, located inside the member 22. The piston acts on a column of liquid which is applied by line 26 to actuator 27 of a hydraulic valve and thus connects the high-pressure line 25 in the drum to the nozzles of a particular group 7A–7F which are directed toward the mine face.

Although the invention has been shown in connection with certain specific embodiments, it will be readily apparent to those skilled in the art that various changes in form a arrangement of parts may be made to suit requirements without departing from the spirit and scope of the invention.

I claim as my invention:

1. A shearer drum apparatus for mining machine used in underground mining, said apparatus including a shearer drum rotatable about an axis, cutter picks and groups of nozzles spaced about the periphery of said shearer drum, a plurality of control valves each connected to one of said groups of nozzles, a line for conducting high-pressure liquid coupled to each of the plurality of control valves, a resilient mounting receiving a cutter pick of said cutter picks which is associated with the nozzles of each group, and transducer means engaged with said resilient mounting means to respond to downward and outward movement of the cutter pick relative to the shearer drum due to changes to the cutting pressure as the cutter pick moves into and out of contact with the mine face for producing a control signal to actuate the control valve of one of said groups of nozzles.

2. The shearer drum apparatus according to claim 1 wherein said transducer means produces an electrical signal for actuating the control valve.

3. The shearer drum apparatus according to claim 1 wherein said transducer means produces a hydraulic signal for actuating the control valve.

4. The shearer drum apparatus according to claim 1 wherein said control valves comprise solenoid operated valves.

5. The shearer drum apparatus according to claim 4 wherein said transducer means comprise pressure detectors.

6. The shearer drum apparatus according to claim 4 wherein said transducer means comprise strain gauges.

7. The shearer drum apparatus according to claim 1 wherein each of said control valves includes a hydraulically operated valve and wherein said transducer means includes an actuator connected by a liquid column to said hydraulically operated valve.

* * * * *